US008789544B2

(12) United States Patent
Kang

(10) Patent No.: US 8,789,544 B2
(45) Date of Patent: Jul. 29, 2014

(54) FILTER ASSEMBLY AND DISHWASHER HAVING THE SAME

(75) Inventor: Myong-Ho Kang, Changwon (KR)

(73) Assignee: LG Electronics Inc., Seoul (KR)

( * ) Notice: Subject to any disclaimer, the term of this patent is extended or adjusted under 35 U.S.C. 154(b) by 930 days.

(21) Appl. No.: 12/187,616

(22) Filed: Aug. 7, 2008

(65) Prior Publication Data

US 2009/0038652 A1 Feb. 12, 2009

(30) Foreign Application Priority Data

Aug. 10, 2007 (KR) ..... 10-2007-0080911

(51) Int. Cl.
*B08B 3/00* (2006.01)

(52) U.S. Cl.
USPC ..... 134/110

(58) Field of Classification Search
CPC ..... A47L 15/4202; A47L 15/4206
USPC ..... 134/57 D, 56 D, 58 D, 104.1, 109, 110, 134/111
See application file for complete search history.

(56) References Cited

U.S. PATENT DOCUMENTS 4,754,772 A * 7/1988 Nord et al. ..... 134/111
4,998,548 A * 3/1991 Lagerstrand ..... 134/111
2003/0205246 A1* 11/2003 Christman et al. ..... 134/18

FOREIGN PATENT DOCUMENTS

DE 698 27 378 11/2005
EP 1386575 A1 * 2/2004

OTHER PUBLICATIONS

German Office Action dated Feb. 2, 2012.

* cited by examiner

*Primary Examiner* — David Cormier
(74) *Attorney, Agent, or Firm* — Ked & Associates, LLP

(57) ABSTRACT

Provided are a filter assembly for a dishwasher and a dishwasher having the same. In the filter assembly for the dishwasher and the dishwasher having the same, since a cylindrical filter unit is formed through a plate filter unit, the entire area of an inside of a filter frame can be implemented as a filtering area where foreign materials contained in water circulating toward dishes to be washed up are filtered off. Accordingly, the extended filtering area can increase an amount of water supplied onto the dishes, thus to enhance an efficiency of water circulation. Also, a possibility that a filter is blocked due to foreign materials covering all over the filtering area can remarkably be reduced. Since the cylindrical filter unit is formed through the plate filter unit, the entire size of the filter assembly can be decreased with maintaining the filtering area of the filter assembly. Hence, no great installation space for a compact dishwasher is required, thereby facilitating the installation of the dishwasher.

12 Claims, 7 Drawing Sheets

FILTER ASSEMBLY AND DISHWASHER HAVING THE SAME

RELATED APPLICATION

The present disclosure relates to subject matter contained in priority Korean Application No. 10-2007-0080911, filed on Aug. 10, 2007, which is herein expressly incorporated by reference in its entirety.

BACKGROUND OF THE INVENTION

1. Field of the Invention

The present invention relates to a dishwasher, and particularly, to a filter for a dishwasher capable of filtering foreign materials.

2. Background of the Invention

In general, a dishwasher is a device to automatically wash dishes, configured such that dishes to be washed up are put on a tub and water is injected onto the dished through a plurality of nozzles disposed at the tub so as to be washed up. Afterwards, foreign materials washed out of the dishes are filtered by a filter assembly installed on the bottom of the tub and water having such foreign materials separated therefrom drains outside.

FIG. 1 shows a general filter assembly. As shown in FIG. 1, a filter assembly 5 includes a filter frame 11, a circulation filter 12 installed inside the filter assembly 5 and having a plurality of filtering openings 12*a* to filter small (tiny) foreign materials off, a drain filter 13 disposed parallel with the circulation filter 12 and having a plurality of mesh openings 13*a* to filter large foreign materials off, and a handle 14 which user grasps.

A user grasps the handle 14 to put a filter frame 11 on a filter groove (not shown) formed at the bottom of a tub, so as to complete the installation of the filter assembly 5.

With such configuration, water from which small foreign materials are filtered off through the filtering openings 12*a* is circulated to dishes to be washed up, and water from which large foreign materials are filtered off through the mesh openings 13*a* are thrown away to the outside.

Meanwhile, the filter assembly 5 includes inside the filter frame 11 both the circulation filter 12 which filters small foreign materials and the drain filter 13 which filters large foreign materials, the circulation filter 12 and the drain filter 13 being parallel with each other. Accordingly, a filtering area of the circulation filter 12 is relatively determined depending on a filtering area of the drain filter 13. Hence, the circulation filter 12 cannot be installed at the entire area inside the filter frame 11, which causes the circulation filter 12 to have a smaller filtering area. Accordingly, if foreign materials cover all over the small filtering area of the circulation filter 12, the circulation filter 12 can be blocked. In addition, the amount of water circulating through the circulation filter 12 is decreased, possibly resulting in a degradation of an efficiency of water circulation.

It is sure that water having foreign materials filtered off through the drain filter 13 can further be filtered and joins water filtered through the circulation filter 12, thus to be supplied onto dishes to be cleaned.

To this end, in case where both the circulation filter 12 and the drain filter 13 are installed at the filter groove, a plurality of communication holes acting as filters are formed through a partition wall interposed between the circulation filter 12 and the drain filter 13. However, such communication holes allow the increase in the filtering area in which foreign materials contained in water circulating through these communication holes can be filtered off; however, the drain filter 13 only filters large foreign materials, whereby foreign materials failed to be filtered by the drain filter 13 can block the communication holes. Hence, it is difficult to expect a filtering effect through the communication holes.

SUMMARY OF THE INVENTION

Therefore, in order to solve the problem of the related art, an object of the present invention is to provide a filter assembly for a dishwasher having an increased filtering area of a filter in which foreign materials are filtered from water circulated.

Another object of the present invention is to provide a dishwasher having the filter assembly with the above-described characteristic.

Another object of the present invention is to provide a compact dishwasher having the filter assembly with the above-described characteristic.

To achieve these and other advantages and in accordance with the purpose of the present invention, as embodied and broadly described herein, there is provided a filter assembly for a dishwasher comprising: a plate filter unit; and a cylindrical filter unit formed through the plate filter unit.

Water having small foreign materials filtered off through the plate filter unit is circulated to be supplied back to dishes. Also, the cylindrical filter unit is implemented in a triplex filtering structure, such that large foreign materials and small foreign materials can sequentially be filtered off. Hence, foreign materials contained in water circulated toward the dishes can be filtered off all over the area inside the filter frame. Thus, the extended filtering area increases the amount of water supplied onto the dishes so as to enhance an efficiency of water circulation. Also, the possibility that foreign materials cover the entire filtering area to thereby block the filter can be remarkably avoided. In addition, the entire size of the filter assembly can be decreased with maintaining the filtering area thereof. Therefore, such filter assembly can be facilitated to be installed in a compact dishwasher.

In one aspect of the present invention, there is provided a dishwasher comprising: a casing; a tub installed inside the casing and having a heater installation groove and a filter installation groove both formed at a bottom surface thereof; and a plate filter unit and a cylindrical filter unit both installed in the filter installation groove, the cylindrical filter unit being formed through the plate filter unit. Since the cylindrical filter unit is installed to penetrate the plate filter unit, the entire size of the filter assembly can be decreased with maintaining the filtering area of the filter assembly, thereby facilitating the installation of the filter assembly in a compact dishwasher.

The cylindrical filter unit may comprise an upper filter disposed on the plate filter unit; an internal filter communicating with the upper filter and disposed under the plate filter unit; and an external filter covering the internal filter by being spaced apart from each other with a certain interval, wherein the internal filter and the external filter are preferably respectively provided with a cutout opening communicating with a drain hole formed at the filter installation groove.

The heater installation groove is covered with a heater cover, and the heater cover is placed to be flush with the plate filter unit. Preferably, a depth H1 of the heater installation groove is the same as a depth H2 of the filter installation groove. Accordingly, the cylindrical filter unit can extend longer down to the bottom of the filter installation groove, thereby further increasing the filtering area where foreign materials contained in water circulated toward dishes can be filtered off.

Preferably, the heater cover and the plate filter unit are respectively provided with a plurality of filtering openings each having the same size. Thus, foreign materials contained in water circulated toward dishes can be filtered off even through the heater cover. Therefore, the filter area where foreign materials contained in water circulated toward the dishes can further be extended.

In another aspect of the present invention, there is provided a compact dishwasher comprising: a casing; a tub installed inside the casing and having a heater installation groove and a filter installation groove formed at a bottom surface thereof by a certain depth; injection arms rotatably installed at the bottom surface of the tub; a heater assembly installed in the heater installation groove; and a filter assembly installed in the filter installation groove, wherein a circulation hole for supplying water stored in the heater installation groove to the injection arms is formed at a side surface of the heater installation groove.

Preferably, a drain hole for draining water contained in the filter installation groove to the outside is formed at a side surface of the filter installation groove. Also, preferably, the heater installation groove and the filter installation groove are separated from each other by a partition wall, which has a communication hole formed therethrough, such that water stored in the filter installation groove can be supplied to the injection arms through the communication hole and the circulation hole.

The filter assembly may include a plate filter unit and a cylindrical filter unit formed through the plate filter unit. The plate filter unit may include a filter frame, and a filter having a filtering area corresponding to the entire area inside the filter frame.

Preferably, the cylindrical filter unit may have therein a space S1 for storing water having foreign materials filtered thereoff, and a space S2 for temporarily storing the foreign materials filtered before being thrown out.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of a filter assembly and a dishwasher having the same in accordance with one embodiment of the present invention, with reference to the accompanying drawings.

Figure 2:
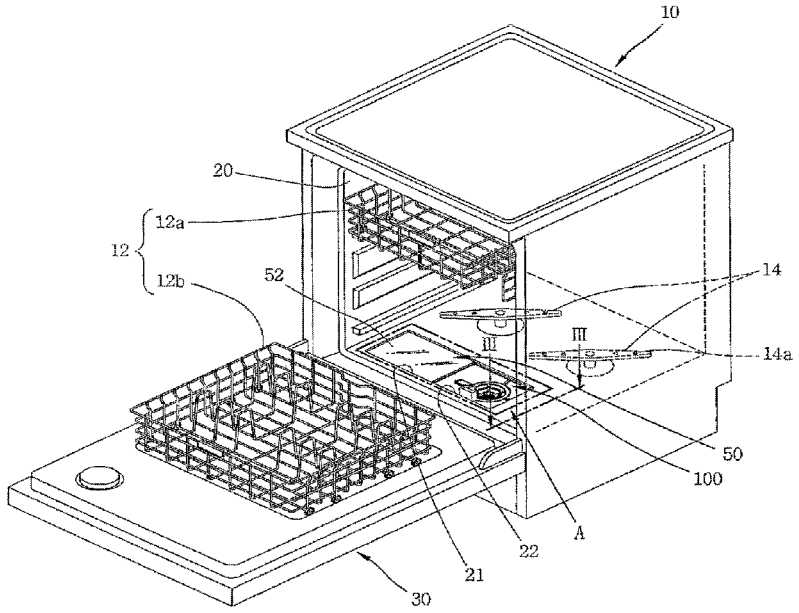
FIG. 2 is a perspective view showing a dishwasher having a filter assembly in accordance with one embodiment of the present invention.

FIG. 2 is a perspective view of a dishwasher having a filter assembly in accordance with one embodiment of the present invention. As shown in FIG. 2, the dishwasher having a filter assembly according to the one embodiment of the present invention may include a casing 10 configuring an outer appearance of the dishwasher, a tub 20 installed inside the casing 10 and having a heater installation groove 21 and a filter installation groove 22 each recessed in a bottom surface by a certain depth, a door 30 for opening/closing an open front face of the casing 10, a heater assembly 50 installed in the heater installation groove 21, and a filter assembly 100 installed in the filter installation groove 22.

A rack assembly 12 including an upper rack assembly 12*a* and a lower rack assembly 12*b* is detachably disposed in the tub 20. Accordingly, dishes to be cleaned can be placed on the rack assembly 12.

A pair of injection arms 14 is rotatably disposed at the bottom surface of the tub 20 to inject washing water onto the dishes.

A plurality of nozzles 14*a* are formed on upper surfaces of the injection arms 14. The injection arms 14 are rotated by a reaction force of water injected from the nozzles 14*a* to scatter (inject) water onto the dishes.

Figure 3:
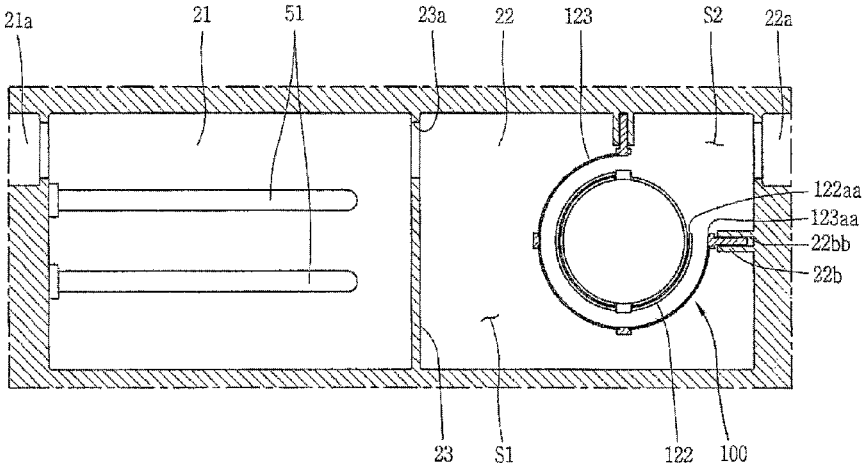
FIG. 3 is an enlarged view of a part A in FIG. 2, which shows a cross-section of the part A in a certain depth taken along the line III-III.
Figure 4:
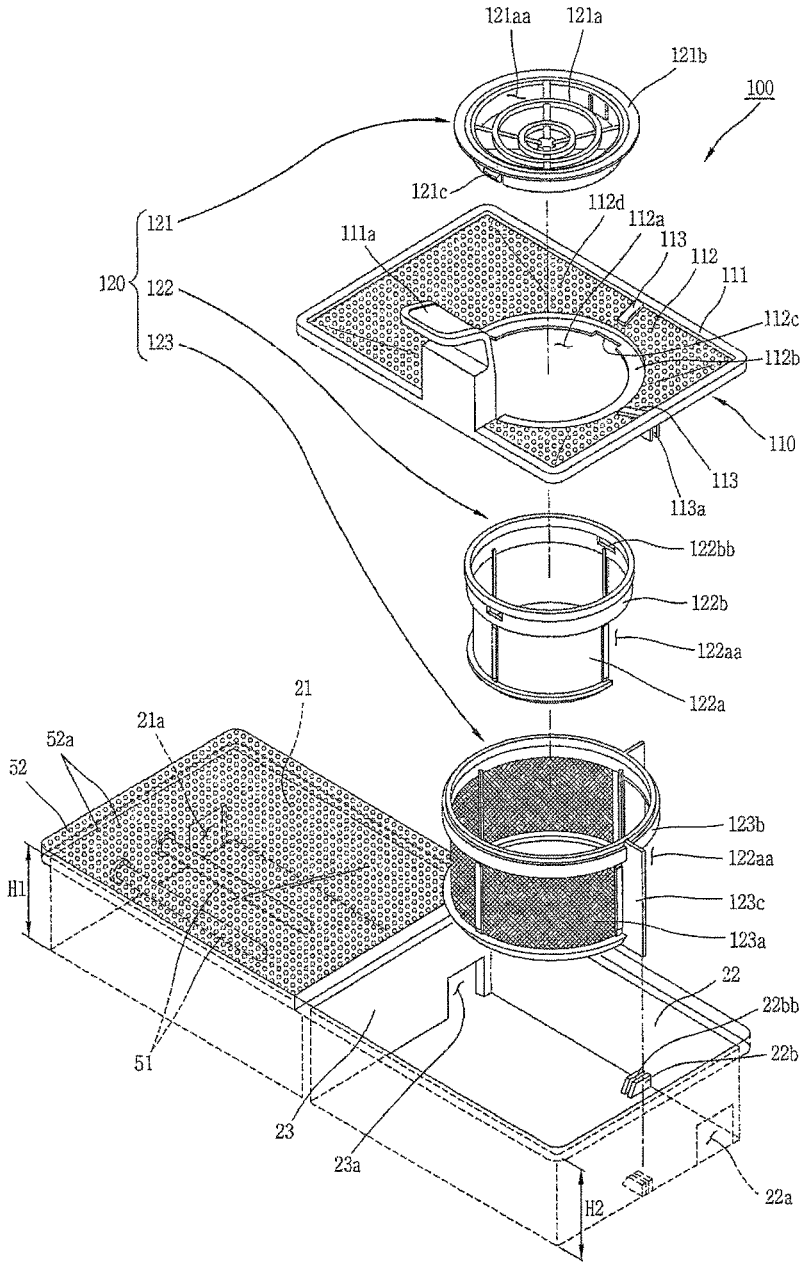
FIG. 4 is an enlarged perspective view of the part A in FIG. 2, in which a part of a filter assembly is shown in a disassembled state.
Figure 5:
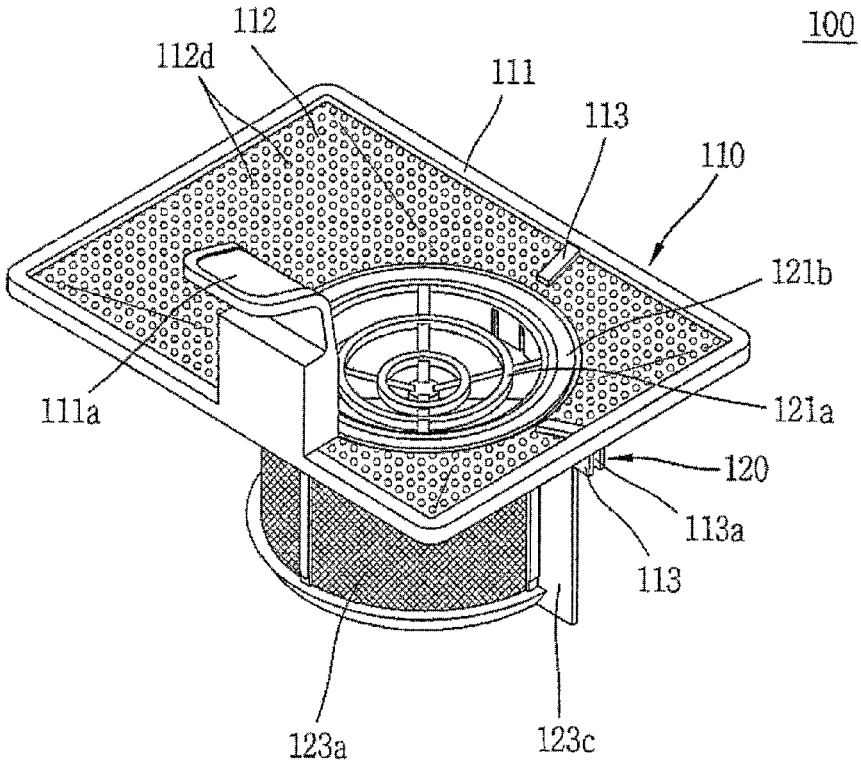
FIG. 5 is a perspective view of the filter assembly in FIG. 4 completely assembled.
Figure 6:
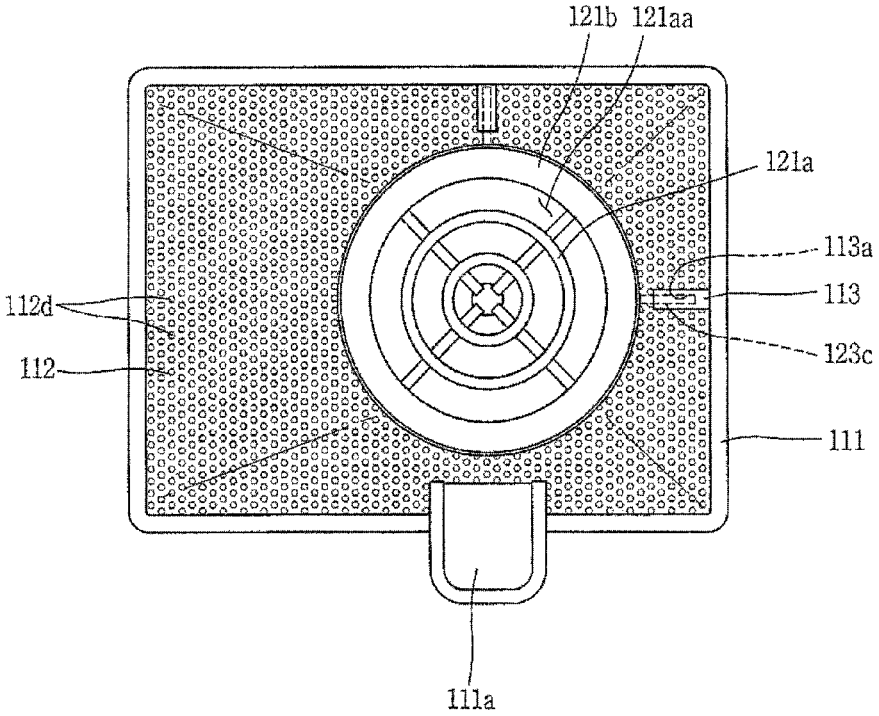
FIG. 6 is a plan view of the filter assembly in FIG. 5.
Figure 7:
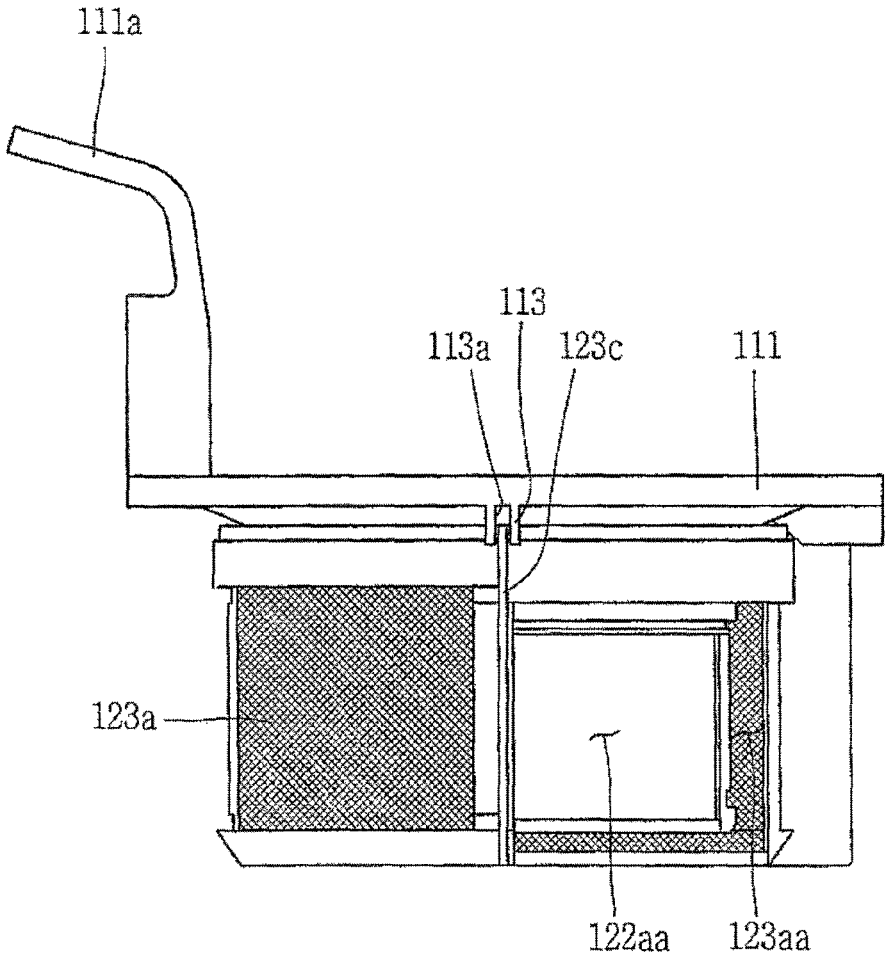
FIG. 7 is a side view of the filter assembly in FIG. 5.

FIG. 3 is an enlarged view of a part A in FIG. 2, which shows a cross-section of the part A in a certain depth taken along the line III-III, FIG. 4 is an enlarged perspective view of the part A in FIG. 2, in which a part of a filter assembly is shown in a disassembled state, FIG. 5 is a perspective view of the filter assembly in FIG. 4 completely assembled, FIG. 6 is a plan view of the filter assembly in FIG. 5, and FIG. 7 is a side view of the filter assembly in FIG. 5.

As shown in FIGS. 3 and 4, a circulation hole 21*a*, which allows water contained in the heater installation groove 21 to be supplied to the injection arms 14 (see FIG. 2) when a circulation pump (not shown) is driven, is formed at one side of the heat installation groove 21.

Here, the circulation hole 21*a* is formed at the side surface, other than at a bottom surface of the heater installation groove 21. That is, in case of forming the circulation hole 21*a* at the bottom surface of the heater installation groove 21, a pipe for connecting the circulation hole 21*a* to the injection arms 14 should be installed under the bottom surface of the heater installation groove 21, which requires a separate installation space under the bottom surface. Such configuration is difficult to be applied to a compact dishwasher such as one provided by the present invention. Hence, the circulation hole 21*a* is formed at the side surface of the heater installation groove 21 other than at the bottom surface thereof, thereby implementing a compact dishwasher.

The heater assembly 50 may include a heater 51 installed inside the heater installation groove 21 and a heater cover 52 for shielding the heater installation groove 21. A plurality of filtering openings 52*a* for filtering small foreign materials are formed through an upper surface of the heater cover 52.

A drain hole 22*a* for allowing water stored in the filter installation groove 22 to be drained to the outside when a drain pump (not shown) is driven is formed at one side of the filter installation groove 22.

Here, the drain hole 22*a* is formed at the side surface of the filter installation groove 22 other than at the bottom surface thereof. That is, in case of forming the drain hole 22*a* at the bottom surface of the filter installation groove 22, a pipe for connecting the drain hole 22*a* to an external drainer should be installed under the bottom surface of the filter installation groove 22, which requires a separate installation space under the bottom surface. Such configuration is difficult to be applied to a compact dishwasher such as one provided by the present invention. Hence, the drain hole 22*a* is formed at the side surface of the filter installation hole 22 other than at the bottom surface thereof, thereby implementing a compact dishwasher.

The heater installation groove 21 and the filter installation groove 22 are separated by a partition wall 23. The partition wall 23 includes a communication hole 23*a* for allowing water stored in the filter installation groove 22 to move to the heater installation groove 21 when the circulation pump (not shown) is driven.

With such configuration, when the circulation pump is driven, water having foreign material filtered off through the filter assembly 100 is induced into the heater installation groove 21 through the communication hole 23*a*.

Water heated by the heater 51 installed in the heater installation groove 21 flows through the circulation hole 21*a* to be supplied back to the injection arms 14. Such water is then injected onto dishes to be cleaned through the nozzles 14*a* formed on the injection arms 14. Meanwhile, when a drain pump is driven, water from which food debris is filtered off through the filter assembly 100 is drained to the outside through the drain hole 22*a*.

Figure 1:
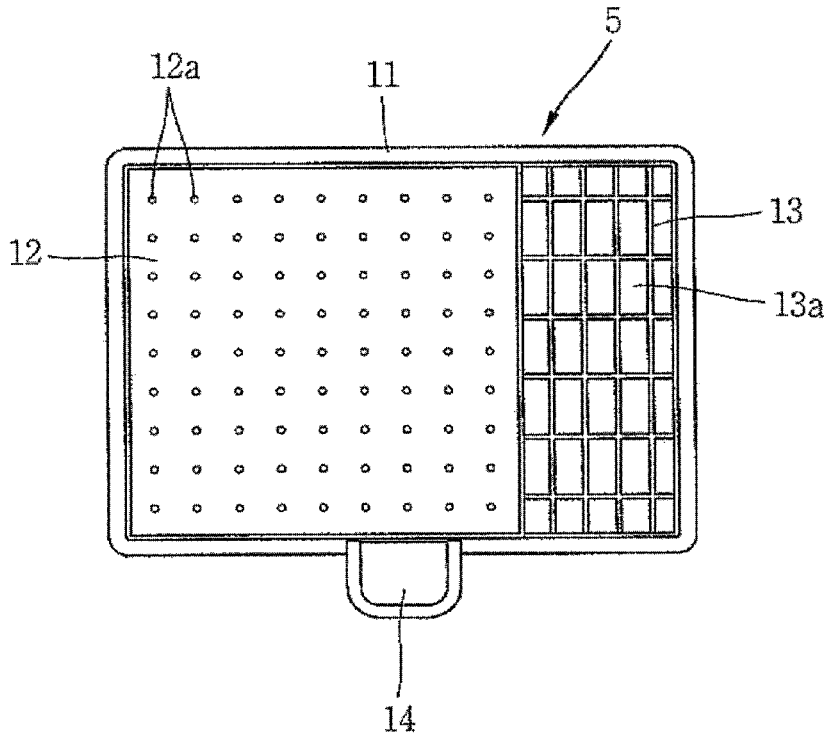
FIG. 1 is a view of a general filter assembly.

As shown in FIGS. 4 to 6, the filter assembly 100 may include a plate filter unit 110, and a cylindrical filter unit 120 formed through the plate filter unit 110. The installation of the cylindrical filter unit 120 through the plate filter unit 110 allows not only maintenance of the filtering area of the filter assembly 100 but also reduction of the entire size of the filter assembly 100, compared to the filter assembly 5 of FIG. 1 having the circulation filter 12 and the drain filter 13 disposed parallel with each other, resulting in facilitating the installation of the filter assembly 100 in a compact dishwasher.

Water having small foreign materials filtered off through the plate filter unit 110 is circulated to be supplied back to the dishes. To this end, the plate filter unit 110 may include a filter frame 111, a filter 112 installed in the filter frame 111, and a filter supporter 113 protruding toward the center of the filter 112 and supporting a bottom surface of the filter 112 so as to prevent the filter 112 from drooping.

The filter 112 is provided with a through hole 112*a* formed at its center and having a stepped portion 112*b*, and a plurality of filtering openings 112*d* formed through the upper surface of the filter 112 and having a short diameter of, for example, about 1~2 mm for filtering small foreign materials off.

A handle 111*a* is formed at one side of the filter frame 111. Accordingly, a user can grasp the handle 111*a* to attach or detach the filter assembly 100 into the filter installation groove 22.

The filter supporter 113 is provided with a coupling groove 113*a* to be coupled to a rib 123*c* of an external filter 123.

The filtering opening 112*d* of the plate filter unit 110 and the filtering opening 52*a* of the heater cover 52 have the same diameter to each other. Thus, the filtering area in which such foreign materials contained in water are filtered off can extend to the heater cover 52, thereby increasing the filtering area.

The plate filter unit 110 having the aforesaid configuration can filter small foreign materials. Water having foreign materials filtered off is supplied back to the injection arms 14 (see FIG. 2) via the filtering openings 112*d*, the communication hole 23*a* and the circulation hole 21*a*. Also, small foreign materials are filtered off through the filtering openings 52*a* of the heater cover 52. The water having foreign materials filtered off is then supplied back to the injection arms 14 (see FIG. 2) through the filtering openings 52*a* and the circulation hole 21*a*. The water supplied is finally injected onto the dishes through the nozzles 14*a* formed on the injection arms 14 (see FIG. 2).

Consequently, the extension of the filtering area increases the amount of water supplied onto the dishes, thus to improve the efficiency of water circulation. In addition, possibility that the filter can be blocked due to the foreign materials covering over the whole filtering area can greatly be reduced.

The cylindrical filter unit 120 may be implemented in a triplex filtering structure. That is, the cylindrical filter unit 120 may include an upper filter 121 disposed on the plate filter unit 110, an internal filter 122 communicating with the upper filter 121 and disposed under the plate filter unit 110, and an external filter 123 covering the internal filter 122 by being spaced apart from each other with a certain interval.

The upper filter 121 may include a body 121*a* formed to be circular and having a plurality of filtering openings 121*aa* formed through an upper surface thereof, an edge 121*b* protruding along an outer circumferential surface of the body 121*a*, and a hook 121*c* formed at a certain portion on the outer circumferential surface of the body 121*a*. Here, the filtering openings 121*aa* are radially disposed from the central portion of the body 121*a* to the outer circumferential surface thereof.

The internal filter 122 may include a cylindrical filter 122*a*, a filter frame 122*b* for supporting the filter 122*a*, and a hook coupling opening 122*bb* formed at the filter frame 122*b*. Also, a cutout opening 122*aa* (see FIG. 3) is formed at one side of the filter 122*a* such that water from which large foreign materials are filtered off can flow into the drain hole 22*a*.

With such configuration, the edge 121*b* of the upper filter 121 is put on the stepped portion 112*b* of the through hole 112*a*. The hook 121*c* penetrates through a passing hole 112*c* formed at the stepped portion 112*b* to thusly be coupled to the hook coupling opening 122*bb* of the internal filter 122, thereby completing the coupling among the filter 112 of the plate filter unit 110, the upper filter 121 and the internal filter 122.

The external filter 123 may include a cylindrical filter 123*a*, a filter frame 123*b* for supporting the filter 123*a*, and a rib 123*c* protruding from the outer circumferential surface of the filter frame 123*b*. Also, a cutout opening 123*aa* (see FIG. 3) is formed at one side of the filter 123*a* such that water from which large foreign materials are filtered off can flow into the drain hole 22*a*.

In the meantime, in order for water flown through the cutout opening 122*aa* of the internal filter 122 to be smoothly drained sequentially through the cutout opening 123*aa* of the external filter 123 and the drain hole 22*a*, the cutout opening 122*aa* of the internal filter 122 and the cutout opening 123*aa* of the external filter 123 are formed at positions corresponding to each other.

That is, as shown in FIGS. 3 and 7, the cutout opening 122*aa* of the internal filter 122 communicates with the cutout opening 123*aa* of the external filter 123. Such cutout openings 122*aa* and 123*aa* allow foreign materials filtered to smoothly move into a foreign material storing space S2, thereby decreasing the possibility that the internal and external filters 122 and 123 can be blocked due to such foreign materials.

As shown in FIGS. 2 to 4, the rib 123*c* is inserted into an insertion groove 22*bb* of a protrusion 22*b* formed at the filter installation groove 22. Accordingly, the external filter 123 covers the internal filter 122 to be completely mounted in the filter installation groove 22. Here, the filter installation groove 22 is divided into a space S1 storing water having foreign materials filtered thereoff and a space S2 storing such foreign materials filtered off.

With the above configuration, large foreign materials and small foreign materials are sequentially filtered off. That is, large foreign materials are filtered off by the upper filter 121, small foreign materials are filtered off by the internal filter 122, and fine foreign materials are filtered off by the external filter 123. Hence, such foreign materials can be filtered off in the triplex filtering structure, thus to supply clean water to the dishes. To this end, the filtering opening 121*aa* of the upper filter 121, the filtering opening (not shown) of the filter 122*a* of the internal filter 122, and the filtering opening (not shown) of the filter 123*a* of the external filter 123 are relatively gradually decreased in their sizes.

The foreign materials filtered water sequentially flows through the communication hole 23*a* and the circulation hole 21*a* to be supplied back to the injection arms 14 (see FIG. 2). The water supplied is then injected onto the dishes through the nozzles 14*a* (see FIG. 2) formed on the injection arms 14 (see FIG. 2).

Meanwhile, the large foreign materials among those filtered foreign materials are accumulated on the upper filter 121. The rest of the foreign materials is once stored in the space S2 (see FIG. 3), and thrown outside through the drain hole 22*a* together with water when the drain pump is driven.

As such, both small foreign materials and large foreign materials all contained in water circulated toward dishes can simultaneously be filtered off by the plate filter unit 110, resulting in an increase in the filtering area where small foreign materials are filtered off.

Hence, the entire area inside the filter frame 111 can effectively be implemented as the filtering area where small foreign materials contained in water circulated toward dishes are filtered off. Therefore, the extension of the filtering area allows an increase in the amount of water supplied onto the dishes, so as to enhance the efficiency of water circulation. In addition, the possibility of blocking the filter due to foreign materials covering all over the filtering area can remarkably be reduced. It is allowed for the heater cover 52 to be flush with the plate filter unit 110. A depth H1 of the heater installation groove 21 is the same as a depth H2 of the filter installation groove 22. Accordingly, the plate filter unit 110 can extend longer down to the bottom of the filter installation groove 22. In other words, the filter 122*a* of the internal filter 122 and the filter 123*a* of the external filter 123 can extend longer down to the bottom of the filter installation groove 22, thus to increase the filtering area. Hence, the filtering effect can be remarkably enhanced.

As described above, in the filter assembly for the dishwasher and the dishwasher having the same in accordance with the one embodiment of the present invention, the entire area of the inside of the filter frame can be implemented as a filtering area where foreign materials contained in water circulated toward dishes to be washed off can be filtered off. Therefore, the extended filter area increases the amount of water supplied onto the dishes so as to enhance an efficiency of water circulation. Also, the possibility that foreign materials cover all over the filter area to thereby block a filter can extremely be reduced. The heater cover is disposed to be flush with the plate filter unit, and the depth of the heater installation groove is implemented to be the same as the depth of the filter installation groove. Accordingly, the cylindrical filter unit can extend longer down to the bottom of the filter installation groove, thereby further increasing the filtering area of the cylindrical filter unit.

Furthermore, since the cylindrical filter unit penetrates the plate filter unit for installation, the entire size of the filter assembly can be decreased with maintaining the filtering area of the filter assembly.

The circulation hole is formed at the side surface of the heater installation groove other than at the bottom surface thereof, so as to make the dishwasher have a compact size.

The drain hole is formed at the side surface of the filter installation groove other than the bottom surface thereof, so as to make the dishwasher have a compact size.

Thus, no larger space is required to install the compact dishwasher, resulting in facilitating the installation of the dishwasher.

Also, the heater cover and the plate filter unit are formed to respectively have a plurality of filtering openings. Such configuration allows the further increase in the filtering area where foreign materials contained in water circulated toward dishes are filtered off.

In addition, the cutout openings of the internal filter and the external filter allow foreign materials filtered to smoothly move into the foreign material storing space, thereby reducing the possibility that the internal filter and the external filter can be blocked due to the foreign materials.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A dishwasher, comprising:

a casing;

a tub installed inside the casing; and the filter assembly having a plate filter and a cylindrical filter formed through the plate filter, wherein the cylindrical filter comprises:

an upper filter disposed on the plate filter;

an internal filter that communicates with the upper filter and disposed under the plate filter; and an external filter that covers the internal filter, wherein the internal filter and the external filter are spaced apart from each other by a certain interval, wherein a cutout opening is longitudinally formed at a side of the external filter and internal filter, respectively, and both the cutout openings communicate with a drain hole formed in the tub, wherein the cutout opening of the internal filter and the cutout opening of the external filter are formed at positions corresponding to each other, wherein a plurality of ribs protrudes from a circumferential portion of the cutout opening of the external filter and external ends of the plurality of ribs contact an internal wall of the tub, wherein a fluid passage is formed by the plurality of ribs that connects an inside of the cylindrical filter and the drain hole, and wherein the plate filter comprises:

a filter frame;

a filter installed inside the filter frame; and at least one filter supporter that protrudes toward a center of the filter of the plate filter and supports a bottom surface of the filter of the plate filter to prevent the filter of the plate filter from drooping, and wherein the at least one filter supporter includes a coupling groove that couples to the plurality of ribs.

2. The dishwasher of claim 1, wherein the filter of the plate filter includes a through hole formed at a center thereof, and wherein the through hole has a stepped portion.

3. The dishwasher of claim 1, wherein the at least one filter supporter of the plate filter is formed at the filter frame of the plate filter.

4. The dishwasher of claim 1, wherein the upper filter comprises:

a circular body having a plurality of filtering openings formed through an upper surface thereof;

an edge that protrudes along an outer circumferential surface of the circular body; and a hook formed at a certain portion of the outer circumferential surface of the body.

5. The dishwasher of claim 4, wherein the plurality of filtering openings is radially disposed from a center of the body toward the outer circumferential surface thereof.

6. The dishwasher of claim 1, wherein the internal filter comprises:

a filter formed to be cylindrical; and a filter frame configured to support the filter of the internal filter and having a hook coupling opening.

7. The dishwasher of claim 1, wherein the external filter comprises:

a filter formed to be cylindrical; and a filter frame configured to support the filter of the external filter, wherein the plurality of ribs protrudes vertically from an outer circumferential surface of the filter frame.

8. The dishwasher of claim 1, wherein the tub includes a heater installation groove and a filter installation groove formed at a bottom surface thereof, wherein the heater installation groove is covered by a heater cover, and wherein the heater cover is disposed to be flush with the plate filter.

9. The dishwasher of claim 8, wherein a depth of the heater installation groove is the same as that of the filter installation groove.

10. The dishwasher of claim 8, wherein the heater cover and the plate filter are respectively provided with a plurality of filtering openings all having the same size.

11. The dishwasher of claim 8, wherein the plurality of ribs protrudes from an outer circumferential surface of the external filter, and wherein the plurality of ribs is each inserted into an insertion groove of a protrusion formed at the filter installation groove.

12. The dishwasher of claim 11, wherein when the plurality of ribs is inserted into the insertion groove, the plurality of ribs divides the filter installation groove into a first space to store water having foreign materials filtered therefrom and a second space to store foreign materials filtered from the water.

* * * * *